United States Patent [19]

Jackson

[11] 4,426,248

[45] Jan. 17, 1984

[54] PROCESS FOR COATING RIFLE TUBES

[75] Inventor: Raymond P. Jackson, West Chester, Pa.

[73] Assignee: The United States of America as represented by the Secretary of the Army, Washington, D.C.

[21] Appl. No.: 496,685

[22] Filed: May 20, 1983

[51] Int. Cl.[3] ..... B44C 1/22; C03C 15/00; C03C 25/06; B05D 7/22

[52] U.S. Cl. ..... 156/645; 156/656; 427/238; 427/239

[58] Field of Search ..... 156/645, 656, 664; 252/79.2; 427/230, 238, 239

[56] References Cited

U.S. PATENT DOCUMENTS

| | | | |
|---|---|---|---|
| 2,619,438 | 11/1952 | Varian et al. | 156/656 X |
| 3,139,363 | 6/1964 | Baldrey | 156/656 X |
| 4,327,134 | 4/1982 | Baldi | 156/664 X |

*Primary Examiner*—William A. Powell

*Attorney, Agent, or Firm*—Robert P. Gibson; Anthony T. Lane; Max Yarmovsky

[57] ABSTRACT

A process for coating the inside diameter of a tube utilizes a coated mandrel which has been first coated in a Ni Cr Al Y slurry, air dried, vacuum sintered, and then inserted in a tube. A mandrel-tube assembly is then swaged and resintered under vacuum conditions. The sintered mandrel-tube assembly is first drilled and then chemically etched to remove remaining mandrel material.

10 Claims, 1 Drawing Figure

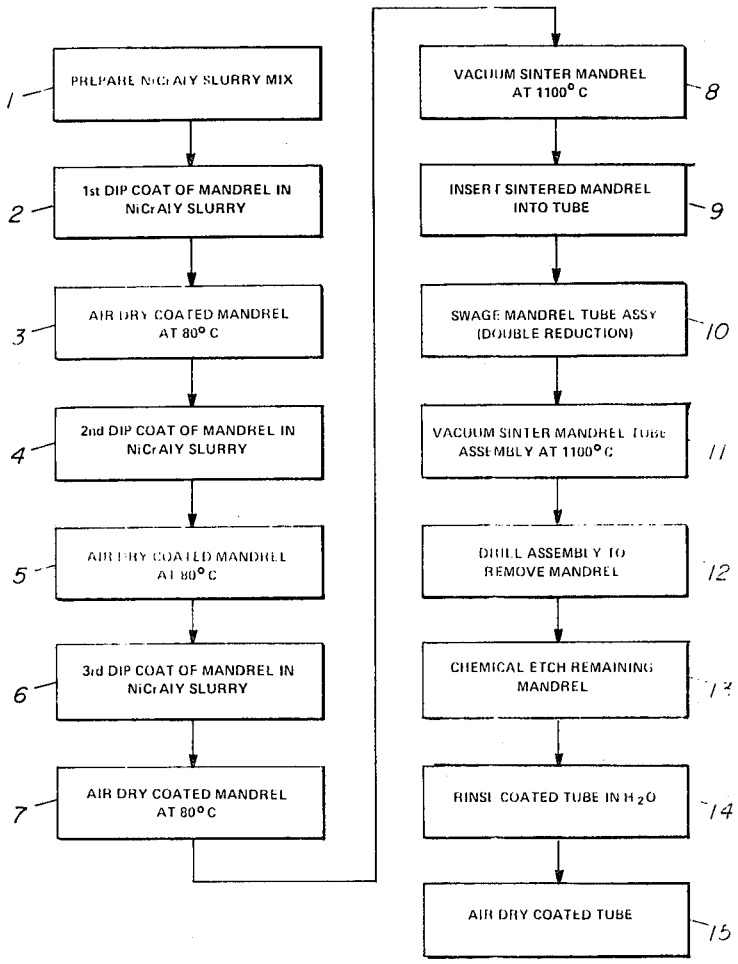

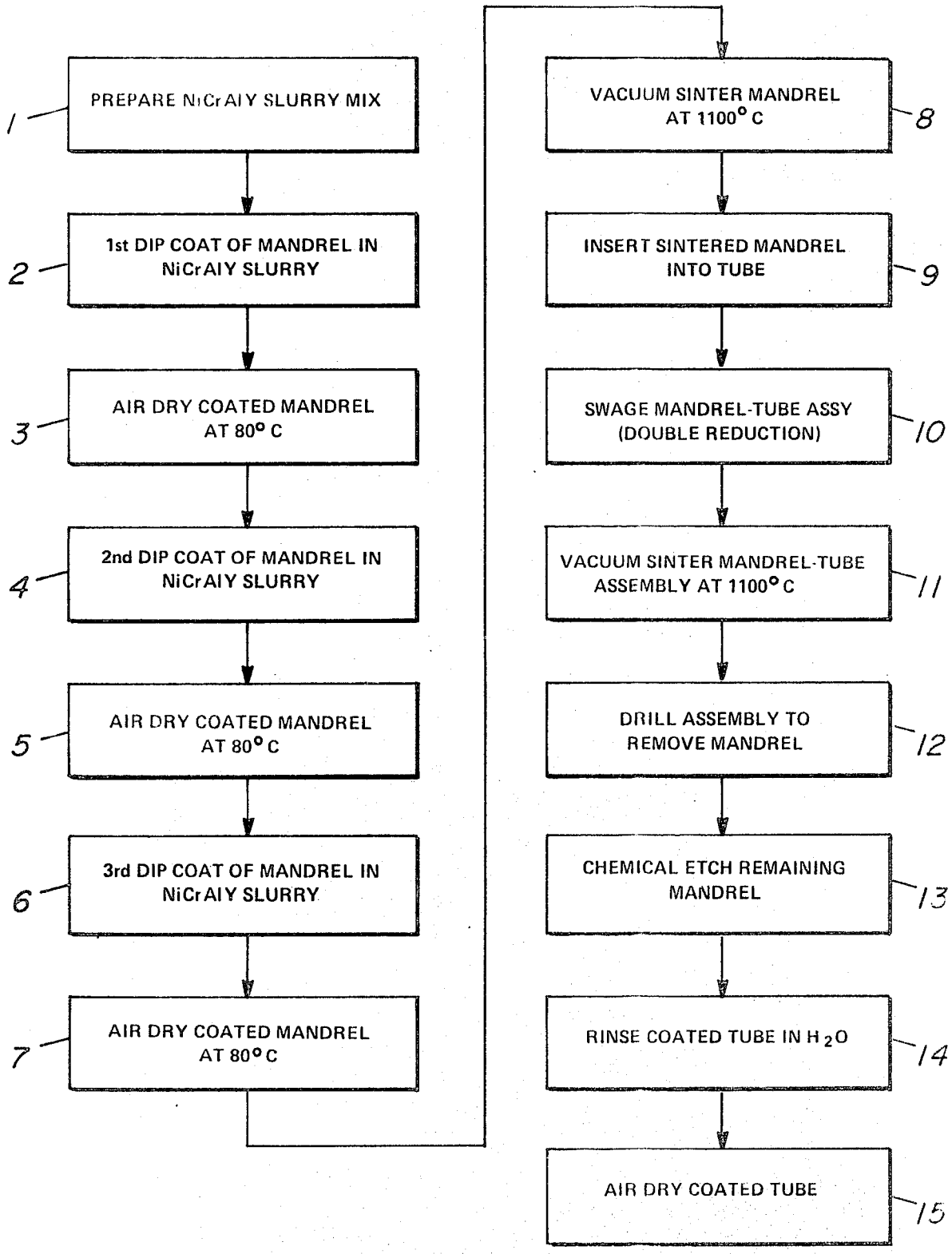
1
PREPARE NiCrAlY SLURRY MIX
2
1st DIP COAT OF MANDREL IN NiCrAlY SLURRY
3
AIR DRY COATED MANDREL AT 80° C
4
2nd DIP COAT OF MANDREL IN NiCrAlY SLURRY
5
AIR DRY COATED MANDREL AT 80° C
6
3rd DIP COAT OF MANDREL IN NiCrAlY SLURRY
7
AIR DRY COATED MANDREL AT 80° C
8
VACUUM SINTER MANDREL AT 1100° C
9
INSERT SINTERED MANDREL INTO TUBE
10
SWAGE MANDREL-TUBE ASSY (DOUBLE REDUCTION)
11
VACUUM SINTER MANDREL-TUBE ASSEMBLY AT 1100° C
12
DRILL ASSEMBLY TO REMOVE MANDREL
13
CHEMICAL ETCH REMAINING MANDREL
14
RINSE COATED TUBE IN H2O
15
AIR DRY COATED TUBE

PROCESS FOR COATING RIFLE TUBES

GOVERNMENTAL INTEREST

The invention described herein may be manufactured, used and licensed by or for the Government for governmental purposes without the payment to me of any royalty thereon.

FIELD OF THE INVENTION

This invention is related to a process for applying a wear resistant metallic slurry composition to the inside diameter of a breech tube sleeve.

BACKGROUND OF THE INVENTION

In the past, chromium plating was the principal method used to successfully prepare gun barrels to combat wear and erosion.

One of the problems with the prior art electroplating method is that it is restricted to certain platable compositions which do not include refractory metals and alloys that could be advantageously used for gun barrel wear and erosion resistant applications. Another problem with electroplating gun barrels is that the process frequently causes hydrogen embrittlement. It is also difficult when electroplating the inside of a gun barrel to obtain a uniform coating and therefore the process is usually time consuming and costly.

A further problem with chromium electroplated gun barrels is that they fail to meet the extreme wear and erosion properties imposed by the latest hypervelocity, rapid fire gun systems presently being developed.

PRIOR ART STATEMENT

A cursory review has been made of Coating Process, interior of hollow article coating, vacuum or pressure utilized under class 427, subclass 238, and no disclosure has been found which may be considered significantly pertinent to the present invention.

SUMMARY OF THE INVENTION

The present invention describes a powder metallurgical process for coating the inside diameter of an insertable sleeve for a gun tube which is resistant to projectile induced wear and propellant gas erosion. A mixture of metal powders are sintered upon a mandrel which is then inserted into a tube sleeve. The mandrel sleeve assembly is swaged and vacuum heat treated to metallurgically bond the coating to the inside of the sleeve. The mandrel is removed from the sleeve by a combination of first mechanically drilling an interior portion of the mandrel material exclusive of the coating, and then removing the remaining mandrel shell by chemical etch. A nickel chromium aluminum yttrium (Ni Cr Al Y) inside surface is obtained which provides a wear and erosion resistant alloy surface for the sleeve that cannot be otherwise appled to the inside diameter of an insertable sleeve for a gun breech.

An object of the present invention is to provide a process for coating the inside diameter of narrow bore tubes which makes them resistant to projectile wear and propellant gas erosion.

Another object of the present invention is to provide a process for metallurgically bonding a Ni Cr Al Y metallic layer to the inside diameter of a tube.

A further object of the present invention is to provide a slurry process for coating the inside of a tube which when inserted into a gun breech of a hypervelocity rapid fire gun system will have wear and erosion properties superior to prior art chromium plated surfaces.

For a better understanding of the present invention, together with other and further objects thereof, reference is made to the following descriptions taken in connection with the accompanying drawing.

DESCRIPTION OF THE PREFERRED EMBODIMENTS

Referring now to the drawing, a slurry mix 1 is prepared by mixing together 187.5 grams of water with 0.42 grams of a suspending agent such as Kelzan, a polysaccharide gum, manufactured by Merk & Co. of Rahway, N.J. with 0.83 grams of a binding agent, such as Polysilicate 48 as manufactured by DuPont, with 118.8 grams of Ni Cr Al Y powder in a blender. The Ni Cr Al Y powder comprises Bal.% Ni particles, 17.1% C particles, 6% Al particles, and 0.3% Y particles. All the metal powder particles are within a range of 5–20 microns. The next step requires the selection of an appropriately sized steel mandrel. Then in steps 2, 4 and 6, the mandrel is successively dip coated in the Ni Cr Al Y slurry mix until the desired diameter is obtained. In the preferred embodiment the mandrel was successively dipped in the slurry mix three times. Air drying steps 3, 5 and 7, at 80° C., are used after each coating step. After the last drying operation, the coated mandrel is sintered, in step 8, in a vacuum oven at a temperature of 1110° C. for 1 hour. The vacuum pressure of the sintering oven is maintained at approximately $10^{-2}$ mm Hg pressure level. The sintered mandrel, in step 9, is next inserted into a tube, made of such material as Inconel. The fit between the inside diameter of the tube and the outside diameter of the coated mandrel should be what is commonly known in the art as a "loose fit". The mandrel-tube assembly is then, in step 10, subjected to a double swaging operation where there is a 3.0% reduction in outside diameter of the tube on the first draw and a 17% reduction in outside diameter on the second pass through the swaging dies. The swaged mandrel-tube assembly is then, in step 11, vacuum fired for 1 hour at 1100° C. while maintaining the vacuum pressure at $10^{-2}$ mm Hg. After the swaged sintered mandrel-tube assembly has been allowed to cool down it is removed from the vacuum firing chamber. The mandrel in step 12 is axially drilled so that a thin hollow mandrel remains. The sintered hollow mandrel-tube assembly is then, in step 13, etched in a warm concentrated nitric acid solution to remove the remaining portions of the mandrel from the assembly. The coated tube is then, in step 14, rinsed in flowing water and then, in step 15, air dried. As previously stated the tube may be made of material such as Inconel. Inconel is a nickel-chromium iron alloy manufactured by International Nickel Co. and selected in the preferred embodiment because of its corrosion resistance and its ability to better maintain structural characteristics at elevated temperatures.

While there has been described and illustrated specific embodiments of the invention, it will be obvious that various changes, modifications and additions can be made herein without departing from the field of the invention which should be limited only by the scope of the appended claims.

What is claimed is:

1. A process for coating the inside diameter of a tube with a wear and erosion resistant coating which includes the steps of:

preparing a slurry mixture of nickel, chromium, aluminum and yttrium powders in an aqueous solution;

selecting a mandrel to fit inside of said tube;

repetitively dip coating said mandrel in said slurry mixture;

air drying said coated mandrel after each dip coating;

sintering said coated mandrel in a vacuum furnace;

inserting said coated mandrel into said tube to form a mandrel-tube assembly;

swaging said mandrel-tube assembly to create a reduction in the outside diameter of said tube;

vacuum sintering of said mandrel-tube assembly after it is swaged;

axially drilling said mandrel in said sintered mandrel-tube assembly to remove material therefrom;

chemically etching said drilled mandrel-tube assembly to remove the remaining mandrel material;

rinsing said chemically etched coated tube in water; and air drying said coated tube.

2. A process as recited in claim 1 wherein said slurry mixture consists of:

187.50 grams of water;

0.42 grams of Kelzan;

8.30 grams of Polysilicate 48; and 118.80 grams of Ni Cr Al Y metal powders.

3. A process as recited in claim 2 wherein said nickel, chromium, aluminum, and yttrium metal powders have a particle size of less than to 20 microns.

4. A process as recited in claim 3 wherein said air drying step includes air drying at a temperature of at least 80° C.

5. A process as recited in claim 4 wherein said sintering step includes heating said coated mandrel in a vacuum to a temperature of 1100° C.

6. A process as recited in claim 5 wherein said swaging step includes a first reduction in the outside diameter of at least 3% and a second reduction of at least 17%.

7. A process as recited in claim 6 wherein said sintering of said mandrel-tube assembly includes heating said mandrel-tube assembly in a vacuum to a temperature of 1100° C.

8. A process as recited in claim 7 wherein said chemical etching step includes etching said drilled mandrel-tube assembly in a heated concentrated nitric acid solution.

9. A process as recited in claim 8 wherein said sintering of said mandrel-tube assembly is heated in a vacuum at a temperature of 1100° C. for at least 1 hour.

10. A process as recited in claim 5 wherein said sintering step of said coated mandrel includes heating said coated mandrel in a vacuum to a temperature of 1100° C. for at least 1 hour.

* * * * *